US005960507A

United States Patent [19]

Dutra et al.

[11] Patent Number: 5,960,507

[45] Date of Patent: Oct. 5, 1999

[54] REMOVABLE TOOTHBRUSH TIMER

[76] Inventors: Phyllis Dutra; Michael Dutra, both of 39354 Waukeena Rd., Clarksburg, Calif. 95612

[21] Appl. No.: 08/933,428

[22] Filed: Sep. 18, 1997

[51] Int. Cl.[6] ..... A46B 9/04; A46B 17/00

[52] U.S. Cl. ..... 15/105; 15/167.1

[58] Field of Search ..... 15/22.1, 105, 167.1; 368/10

[56] References Cited

U.S. PATENT DOCUMENTS

| | | | |
|---|---|---|---|
| 4,450,599 | 5/1984 | Scheller et al. | 15/22.1 |
| 4,476,604 | 10/1984 | White et al. | 15/105 |
| 4,788,734 | 12/1988 | Bauer | 15/105 |
| 5,331,707 | 7/1994 | Irizarry | 15/167.1 |
| 5,438,726 | 8/1995 | Leite | 15/105 |
| 5,544,382 | 8/1996 | Giuliani et al. | 15/22.1 |
| 5,572,762 | 11/1996 | Scheiner | 15/105 |
| 5,894,453 | 4/1999 | Pond | 15/105 |

FOREIGN PATENT DOCUMENTS

| | | | |
|---|---|---|---|
| 2252234 | 8/1992 | United Kingdom | 15/105 |

*Primary Examiner*—Terrence R. Till

[57] ABSTRACT

A removable toothbrush timer is provided including a conventional toothbrush with a stem having a gripping end and a brush end with a plurality of bristles coupled thereto and extending therefrom. Further provided is a housing having a hollow configuration. The housing has a battery compartment and a toothbrush compartment for releasably receiving the gripping end of the toothbrush. A speaker is situated on the housing for emitting an audio signal upon each actuation thereof. An actuator button is adapted to transmit an activation signal upon the depression thereof. Finally, an application specific integrated circuit is adapted to actuate the speaker upon the cessation of a predetermined time period after the receipt of the activation signal.

10 Claims, 2 Drawing Sheets

REMOVABLE TOOTHBRUSH TIMER

BACKGROUND OF THE INVENTION

1. Field of the Invention

The present invention relates to toothbrush timers and more particularly pertains to a new removable toothbrush timer for allowing the removal and reuse of a toothbrush timer upon the replacement of a toothbrush.

2. Description of the Prior Art

The use of toothbrush timers is known in the prior art. More specifically, toothbrush timers heretofore devised and utilized are known to consist basically of familiar, expected and obvious structural configurations, notwithstanding the myriad of designs encompassed by the crowded prior art which have been developed for the fulfillment of countless objectives and requirements.

Known prior art toothbrush timers include U.S. Pat. No. 4,788,734; U.S. Pat. No. 4,450,599; U.S. Pat. No. 4,836,415; U.S. Pat. No. 4,991,755; U.S. Pat. No. Des. 330,822; and U.S. Pat. No. 5,331,707.

In these respects, the removable toothbrush timer according to the present invention substantially departs from the conventional concepts and designs of the prior art, and in so doing provides an apparatus primarily developed for the purpose of allowing the removal and reuse of a toothbrush timer upon the replacement of a toothbrush.

SUMMARY OF THE INVENTION

In view of the foregoing disadvantages inherent in the known types of toothbrush timers now present in the prior art, the present invention provides a new removable toothbrush timer construction wherein the same can be utilized for allowing the removal and reuse of a toothbrush timer upon the replacement of a toothbrush.

The general purpose of the present invention, which will be described subsequently in greater detail, is to provide a new removable toothbrush timer apparatus and method which has many of the advantages of the toothbrush timers mentioned heretofore and many novel features that result in a new removable toothbrush timer which is not anticipated, rendered obvious, suggested, or even implied by any of the prior art toothbrush timers, either alone or in any combination thereof.

To attain this, the present invention generally comprises a conventional toothbrush with a solid plastic stem. Such stem has a gripping end with a rectilinear cross-section and a brush end with a plurality of bristles coupled thereto and extending therefrom. Note FIG. 1. As shown in both FIGS. 1 & 2, an elastomeric housing is provided having a hollow cylindrical configuration with a circular first open end and a circular second open end. The housing is further equipped with a divider formed in an interior thereof adjacent the first open end. Such divider defines an elongated toothbrush compartment and a short battery compartment. The housing further has a plurality of threaded grooves formed an outer surface thereof adjacent the first open end thereof. A cap with a plurality of threads is included for removably engaging the threaded grooves of the housing, thereby allowing selective access to the battery compartment. Also included is a speaker situated on the outer surface of the housing adjacent the battery compartment thereof. In use, the speaker is adapted for emitting an instantaneous tone upon each actuation thereof. Associated therewith is an actuator push button situated on the outer surface of the housing adjacent a central extent thereof. The push button is adapted to transmit an activation signal upon the depression thereof. For powering purposes, a watch battery is removably situated within the battery compartment of the housing. Finally, an application specific integrated circuit is connected between the speaker, push button, and battery. The operation of the circuit is set forth in FIG. 3. As shown, the circuit is adapted to immediately actuate the speaker button once upon the receipt of the activation signal. Thereafter, the circuit actuates the speaker once upon the cessation of ½ a predetermined time period. Lastly, the circuit actuates the speaker a plurality of times upon the cessation of the predetermined time period. Preferably, such predetermined amount of time is equal to the recommended time the user should brush his or her teeth.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new removable toothbrush timer apparatus and method which has many of the advantages of the toothbrush timers mentioned heretofore and many novel features that result in a new removable toothbrush timer which is not anticipated, rendered obvious, suggested, or even implied by any of the prior art toothbrush timers, either alone or in any combination thereof.

It is another object of the present invention to provide a new removable toothbrush timer which may be easily and efficiently manufactured and marketed.

It is a further object of the present invention to provide a new removable toothbrush timer which is of a durable and reliable construction.

An even further object of the present invention is to provide a new removable toothbrush timer which is susceptible of a low cost of manufacture with regard to both materials and labor, and which accordingly is then susceptible of low prices of sale to the consuming public, thereby making such removable toothbrush timer economically available to the buying public.

Still yet another object of the present invention is to provide a new removable toothbrush timer which provides in the apparatuses and methods of the prior art some of the advantages thereof, while simultaneously overcoming some of the disadvantages normally associated therewith.

Still another object of the present invention is to provide a new removable toothbrush timer for allowing the removal and reuse of a toothbrush timer upon the replacement of a toothbrush.

Even still another object of the present invention is to provide a new removable toothbrush timer that includes a conventional toothbrush with a stem having a gripping end and a brush end with a plurality of bristles coupled thereto and extending therefrom. Further provided is a housing having a hollow configuration. The housing has a battery compartment and a toothbrush compartment for releasably receiving the gripping end of the toothbrush. A speaker is situated on the housing for emitting an audio signal upon each actuation thereof. An actuator button is adapted to transmit an activation signal upon the depression thereof. Finally, an application specific integrated circuit is adapted to actuate the speaker upon the cessation of a predetermined time period after the receipt of the activation signal.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
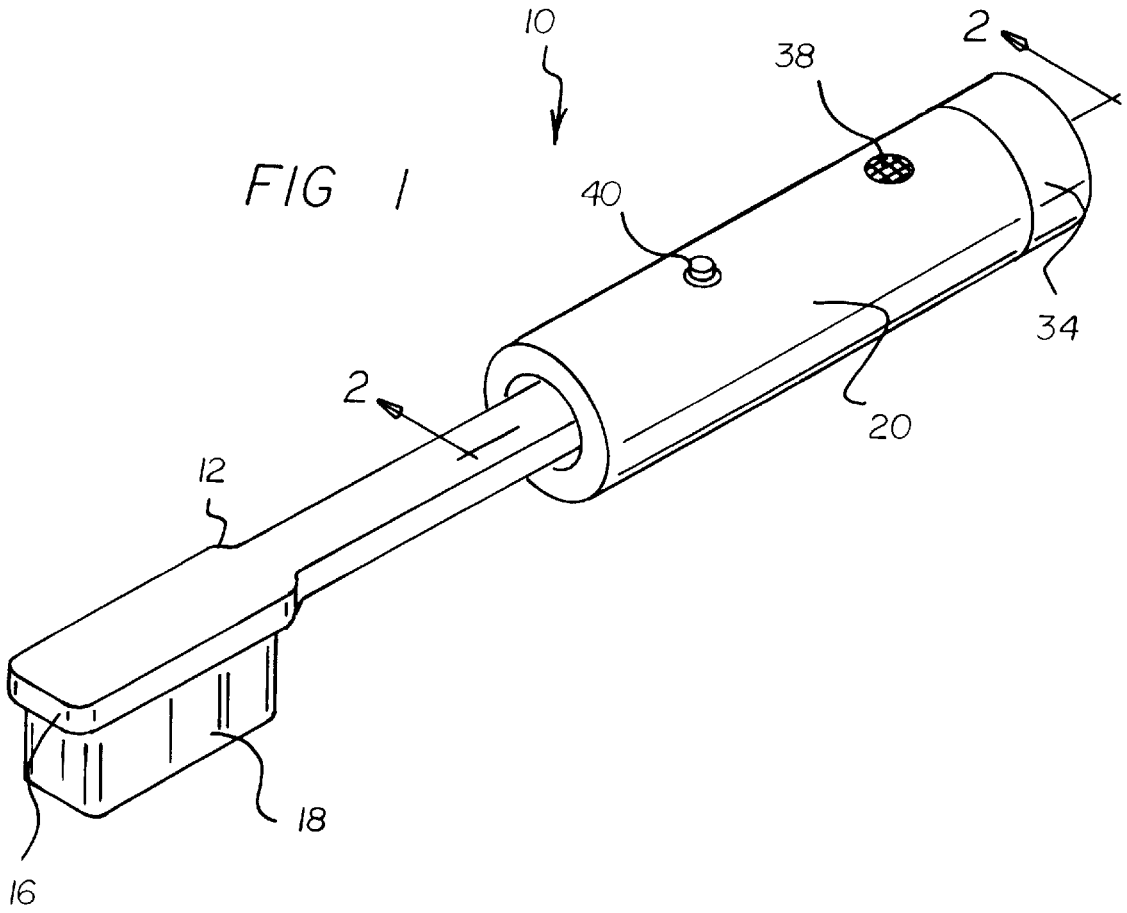
FIG. 1 is a perspective view of a new removable toothbrush timer according to the present invention.

With reference now to the drawings, and in particular to FIGS. 1 through 4 thereof, a new removable toothbrush timer embodying the principles and concepts of the present invention and generally designated by the reference numeral 10 will be described.

The system designate as numeral 10 is adapted for use with conventional toothbrush 12 with a solid plastic stem. Such stem has a gripping end 14 with a rectilinear cross-section and a brush end 16 with a plurality of bristles 18 coupled thereto and extending therefrom. Note FIG. 1.

Figure 2:
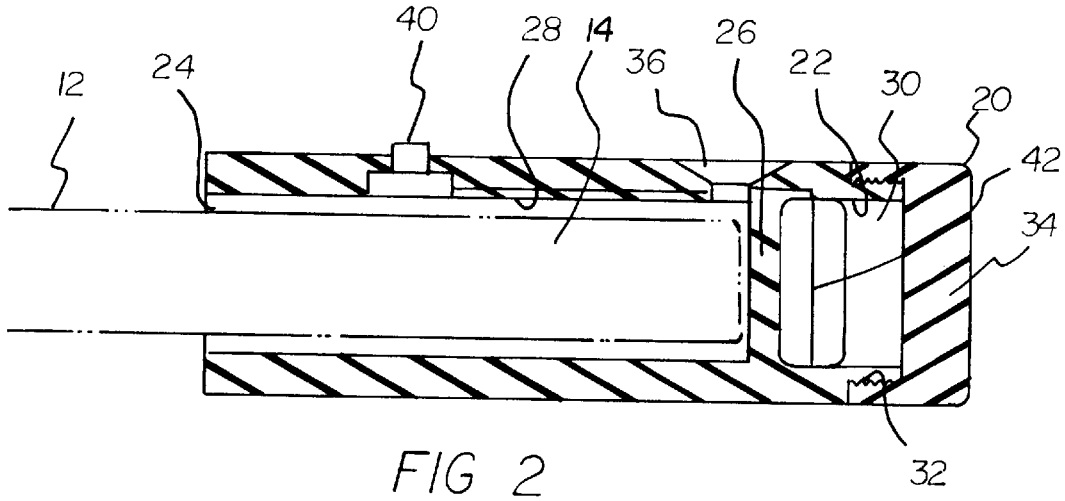
FIG. 2 is a cross-sectional view of the present invention.
Figure 3:
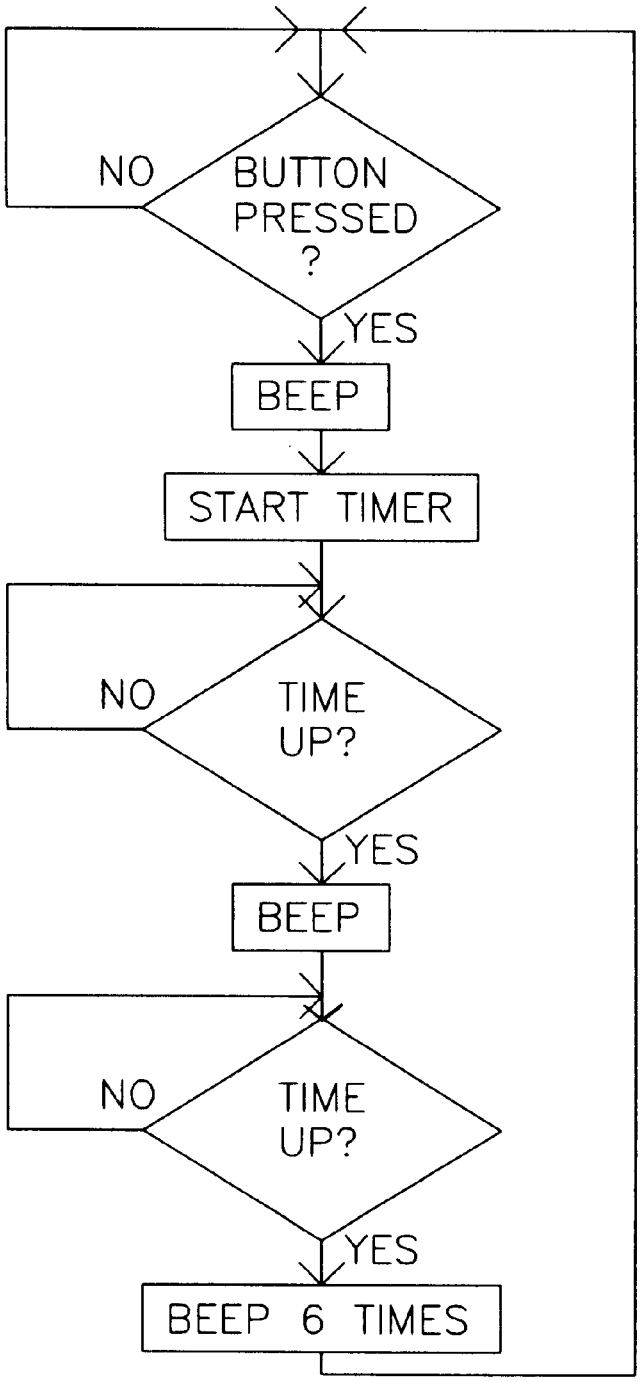
FIG. 3 is a flow chart depicting the operation of the present invention.
Figure 4:
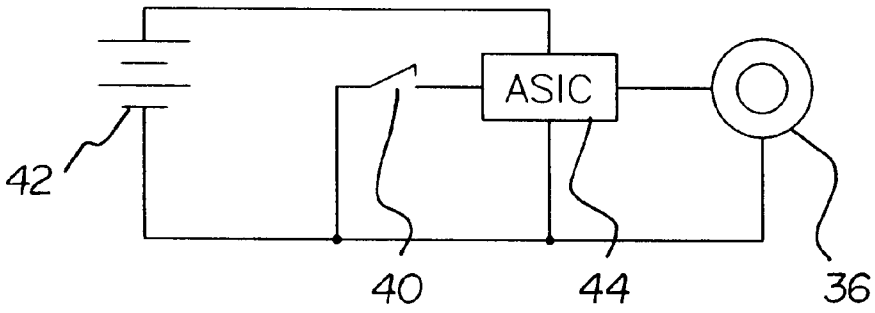
FIG. 4 is a schematic diagram of the electrical components associated with the present invention.

As shown in both FIGS. 1 & 2, an elastomeric housing 20 is provided having a hollow cylindrical configuration with a circular first open end 22 and a circular second open end 24. The housing is further equipped with a divider 26 formed in an interior thereof adjacent the first open end. Such divider defines an elongated toothbrush compartment 28 and a short battery compartment 30. While not shown, an outer surface of the housing is knurled to define a gripping surface.

It should be noted that a diameter of the hollow interior is preferably slightly less than the width of the gripping end of the tooth brush to afford a secure fit. In the preferred embodiment, the housing has a length of 1 and ¾ inches and a diameter of 1 and ½ inches. As shown in FIG. 2, the battery compartment has a length less than ¼ that of the toothbrush compartment.

The housing further has a plurality of threaded grooves 32 formed an outer surface thereof adjacent the first open end thereof. A cap 34 with a plurality of threads is included for removably engaging the threaded grooves of the housing, thereby allowing selective access to the battery compartment. When coupled to the housing, a periphery of the cap remains flush with the outer surface of the housing. In the alternative, the cap may be excluded and the battery compartment may be inaccessible, thus rendering a disposable device.

Also included is a speaker 36 situated on the outer surface of the housing adjacent the battery compartment thereof. Alternatively, a low power piezo electric buzzer may be employed. In use, the speaker is adapted for emitting an instantaneous tone upon each actuation thereof. As an option, a water proof grill 38 may positioned over the speaker, as shown in FIG. 1.

Associated therewith is an actuator push button 40 situated on the outer surface of the housing adjacent a central extent thereof. The push button is situated in alignment with the speaker. The push button is adapted to transmit an activation signal upon the depression thereof. For powering purposes, a watch battery 42 is removably situated within the battery compartment of the housing and connected to the push button.

Finally, an application specific integrated circuit(ASIC) 44 is connected between the speaker, push button, and battery. The operation of the circuit is set forth in FIG. 3. As shown, the circuit is adapted to immediately actuate the speaker button once upon the receipt of the activation signal. This effects a single beep. Thereafter, the circuit actuates the speaker once upon the cessation of ½ a predetermined time period. This is for indicating that a brushing period is half over. Lastly, the circuit actuates the speaker six times upon the cessation of the predetermined time period. Preferably, such predetermined amount of time is equal to the recommended time the user should brush his or her teeth, approximately 2 minutes.

As an option, the circuit 44 may further be adapted to emit via the speaker music and/or brushing instructions in cartoon character voices or the like during the duration of the predetermined time period of 2 minutes. It should be noted that the circuit will unconditionally continue the music and cease with the beep at the end of the predetermined time period despite the subsequent depression of the push button.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A removable toothbrush timer comprising, in combination:

a conventional toothbrush with a solid plastic stem having a gripping end with a rectilinear cross-section and a brush end with a plurality of bristles coupled thereto and extending therefrom;

an elastomeric housing having a hollow cylindrical configuration with a circular first open end and a circular second open end, the housing further having a divider formed in an interior thereof adjacent the first open end for defining an elongated toothbrush compartment and a short battery compartment, the housing further having a plurality of threaded grooves formed an outer surface thereof adjacent the first open end thereof and a cap with a plurality of threads for removably engaging the threaded grooves of the housing thereby allowing selective access to the battery compartment;

a speaker situated on the outer surface of the housing adjacent the battery compartment thereof for emitting an instantaneous tone upon each actuation thereof;

an actuator push button situated on the outer surface of the housing adjacent a central extent thereof, the push button adapted to transmit an activation signal upon the depression thereof;

a watch battery removably situated within the battery compartment of the housing; and an application specific integrated circuit connected between the speaker, push button, and battery, the circuit adapted to immediately actuate the speaker button once upon the receipt of the activation signal, actuate the speaker once upon the cessation of ½ a predetermined time period after the receipt of the activation signal, and actuate the speaker a plurality of removable toothbrush timer on the cessation of the predetermined time period after the receipt of the activation signal.

2. A removable toothbrush timer comprising:

a conventional toothbrush with a stem having a gripping end and a brush end with a plurality of bristles coupled thereto and extending therefrom;

a housing having a hollow configuration, the housing having a battery compartment and a toothbrush compartment for releasably receiving the gripping end of the toothbrush;

a speaker situated on the housing for emitting an audio signal upon each actuation thereof;

an actuator button adapted to transmit an activation signal upon the depression thereof;

a battery situated within the battery compartment of the housing; and a circuit connected between the speaker, button, and battery, the circuit adapted to actuate the speaker upon the cessation of a predetermined time period after the receipt of the activation signal.

3. A removable toothbrush timer as set forth in claim 2 wherein the circuit is adapted to actuate the speaker a plurality of times upon the cessation of the predetermined time period.

4. A removable toothbrush timer as set forth in claim 2 wherein the circuit is further adapted to immediately actuate the speaker button once upon the receipt of the activation signal.

5. A removable toothbrush timer as set forth in claim 2 wherein the circuit is further adapted to actuate the speaker upon the cessation of ½ a predetermined time period after the receipt of the activation signal.

6. A removable toothbrush timer as set forth in claim 2 wherein the housing has circular first open end and a circular second open end, the housing further having a divider formed in an interior thereof adjacent the first open end for defining an elongated toothbrush compartment and a short battery compartment.

7. A removable toothbrush timer as set forth in claim 2 wherein a cap is removably coupled over the battery compartment.

8. A removable toothbrush timer as set forth in claim 2 wherein the housing is elastomeric.

9. A removable toothbrush timer as set forth in claim 2 wherein the actuator button is a manually depressed push button.

10. A removable toothbrush timer comprising:

a toothbrush;

a hollow housing having a battery compartment and a toothbrush compartment receiving the toothbrush therein;

a speaker mounted to the housing for emitting an audio signal upon each actuation thereof;

an actuator button adapted to transmit an activation signal upon the depression thereof;

a battery disposed in the battery compartment; and a circuit connected between the speaker, button, and battery, the circuit adapted to actuate the speaker upon the cessation of a predetermined time period after the receipt of the activation signal;

wherein the circuit is further adapted to actuate the speaker upon the cessation of ½ a predetermined time period after the receipt of the activation signal.

* * * * *